United States Patent [19]

Tokitsu

[11] 4,217,095

[45] Aug. 12, 1980

[54] REHEATING FURNACE FOR USE IN A HOT ROLLING LINE

[76] Inventor: Tetsuya Tokitsu, 21-10, Izumigaoka, Takarazuka-shi, Hyogo-ken, Japan

[21] Appl. No.: 941,637

[22] Filed: Sep. 12, 1978

Related U.S. Application Data

[62] Division of Ser. No. 799,312, May 23, 1977, Pat. No. 4,170,815.

[51] Int. Cl.[2] ..... B22D 11/128; F27B 9/02

[52] U.S. Cl. ..... 432/128; 432/6; 29/527.7; 164/82

[58] Field of Search ..... 432/6, 128, 123, 126, 432/122, 146, 153, 166, 167, 169, 234; 29/527.7; 164/82

[56] References Cited

U.S. PATENT DOCUMENTS

| | | | |
|---|---|---|---|
| 874,039 | 12/1907 | Smallwood | 432/153 |
| 1,378,326 | 5/1921 | Costello | 432/6 |
| 1,613,054 | 1/1927 | Prouty et al. | 432/153 |
| 1,895,726 | 1/1933 | Offutt | 432/6 |
| 2,406,554 | 8/1946 | Marsh | 432/6 |
| 2,504,707 | 4/1950 | Lloyd | 432/6 |
| 3,588,059 | 6/1971 | Weineck | 432/234 |
| 3,792,965 | 2/1974 | Bengtsson | 432/122 |
| 3,851,091 | 11/1974 | Laws | 432/127 |
| 4,025,298 | 5/1977 | Tokitsu | 432/122 |
| 4,170,815 | 10/1979 | Tokitsu | 432/5 |

*Primary Examiner*—Henry C. Yuen

*Attorney, Agent, or Firm*—Wenderoth, Lind & Ponack

[57] ABSTRACT

A reheating furnace for use in a hot rolling line including a heating furnace which is positioned between a continuous casting apparatus and a rolling apparatus rolling workpieces at a higher speed than they are cast by the casting process, the furnace serving as a heating and buffer zone. The reheating furnace is longitudinally divided into two heating sections which are changed over so as to receive workpieces for heating and the workpieces are charged into one of the two sections after the other of the two sections has been filled up. The furnace is operated to collectively forward the workpieces heated up to predetermined rolling temperatures to the rolling apparatus for efficient rolling.

2 Claims, 11 Drawing Figures

200t
200t
200t
200t
3hr

Converter

Continuous Casting

Furnace
100t
400t
6hr

Mill
1.5hr
(f) (g) (h) (i) (j)
Time

REHEATING FURNACE FOR USE IN A HOT ROLLING LINE

This application is a division of Ser. No. 799,312, filed 5/23/1977, and now U.S. Pat. No. 4,170,815.

The present invention relates to a hot rolling apparatus, and more particularly to a reheating furnace for use in a hot rolling line.

Commonly, in modern steel making plants' achievement of energy and labor savings and high efficiency has constantly been sought by making various processes involved continuous. The production line ranging from the continuous casting process to the rolling process has been included in such efforts, and making such process continuous has been attempted by arranging a reheating furnace between the continuous casting machine and the rolling mill. In the conventional arrangements as described above, since the speed for the continuous casting differs to a large extent from that of the rolling, with the latter being normally several times higher than the former, the reheating furnace employed is required to serve as a buffer or absorbing zone for absorbing the difference in through put capacity between the two processes as far as possible. More specifically, in order to meet the requirement as described above, it becomes necessary to employ a reheating furnace capable of simultaneously discharging workpieces for rolling at a higher speed and continuously being charged with workpieces casting process at a lower speed without altering the transportation rate of such workpieces. Additionally, such a reheating furnace should be so arranged as to achieve labour saving through reduction, as far as possible, of the frequency of on-off operations for the rolling mill operated at high speed by storing therein a predetermined amount of workpieces to be rolled which have been cast continuously at low speed and also by collectively forwarding such workpieces in one group from the furnace to the rolling mill. For the purpose as described above, the reheating furnace must be provided, without increasing the length thereof, with heating and heat holding capability for retaining the heat of heated workpieces to be rolled until the workpiece last charged into the furnace has been heated up to the predetermined rolling temperature. If the higher speed emitting and lower speed continuous charging of the workpieces are to be effected simultaneously in one furnace for heating and holding workpieces for transporting the workpieces within the furnace inevitably tend to be long, resulting in an uneconomical reheating furnace and the length of the furnace is increased to that extent. In order to avoid the increase in the furnace length, it is necessary to provide driving units at the front and rear portions of the furnace or to provide several workpiece loading stations, which arrangement, however, is not practical due to various limitations related to actual operations and increased thermal loss arising from heating unnecessary portions of the furnace. Similarly, it might be possible to provide a plurality of reheating furnaces in parallel, but such an arrangement results in increased installation cost, simultaneously requiring a large space.

Accordingly, an essential object of the present invention is to provide an improved reheating furnace for reheating workpieces or materials to be rolled in a hot rolling line in which thermal loss in a reheating furnace having a small space is advantageously reduced for efficient heating and holding of workpieces to be rolled, with substantial elimination of the disadvantages inherent in the conventional heating furnace.

To that end the present invention provides an improved reheating furnace for effecting the heating operation thereof in an efficient manner at low installation cost.

The reheating furnace of the above described type is simple in construction and stable in operation and can readily be incorporated into the hot rolling line.

In accomplishing these and other objects, according to one preferred embodiment of the present invention, a reheating furnace is positioned between a continuous casting apparatus casting a slab at a low speed and a rolling apparatus rolling slab at a higher speed than the slab is being cast, the reheating furnace serving as a heating and buffer zone. The reheating furnace is longitudinally divided into two heating sections which are alternately changed over to receive workpieces for heating so that the workpieces are charged into one of the two sections after the other of the two sections has been filled up, and also to collectively forward the workpieces which have been heated up to the predetermined rolling temperatures to the rolling appartus for efficient rolling operations, and thus not only is the thermal loss in the small reheating furnace reduced, but an increase of furnace length is advantageously avoided and the installation cost is kept low as compared with the case wherein a plurality of reheating furnaces are provided for such purpose.

These and other objects and features of the present invention will become apparent from the following description taken in conjunction with the preferred embodiment thereof with reference to the accompanying drawings, in which, FIG. 1 is a perspective view showing an arrangement of a hot rolling line from a continuous casting apparatus to a rolling apparatus and to which the present invention may be applied;

Figure 5:
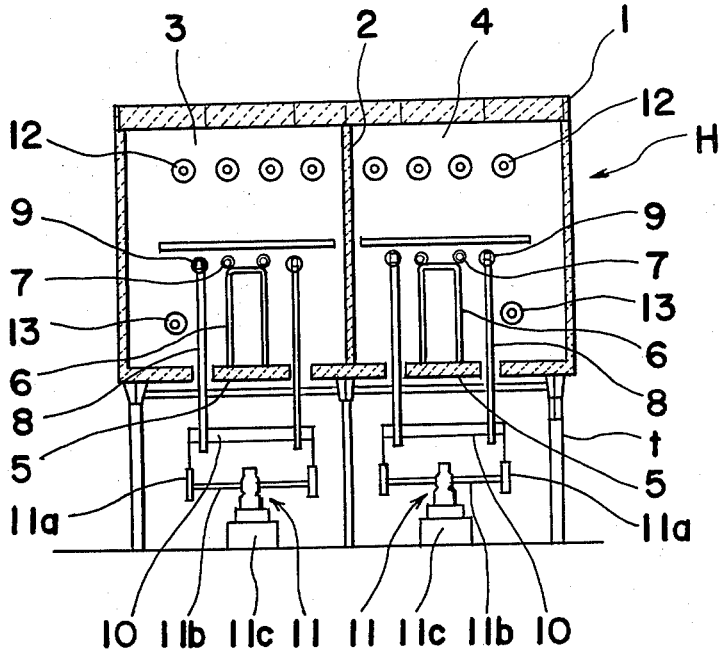
FIG. 5 is a cross sectional view of the reheating furnace of FIG. 4.
Figure 6:
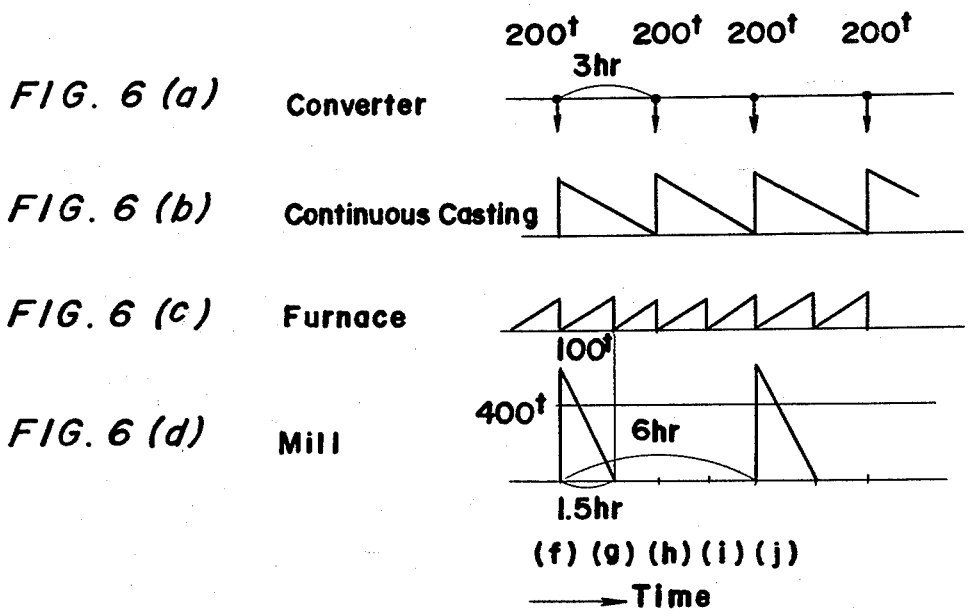
Figure 7:
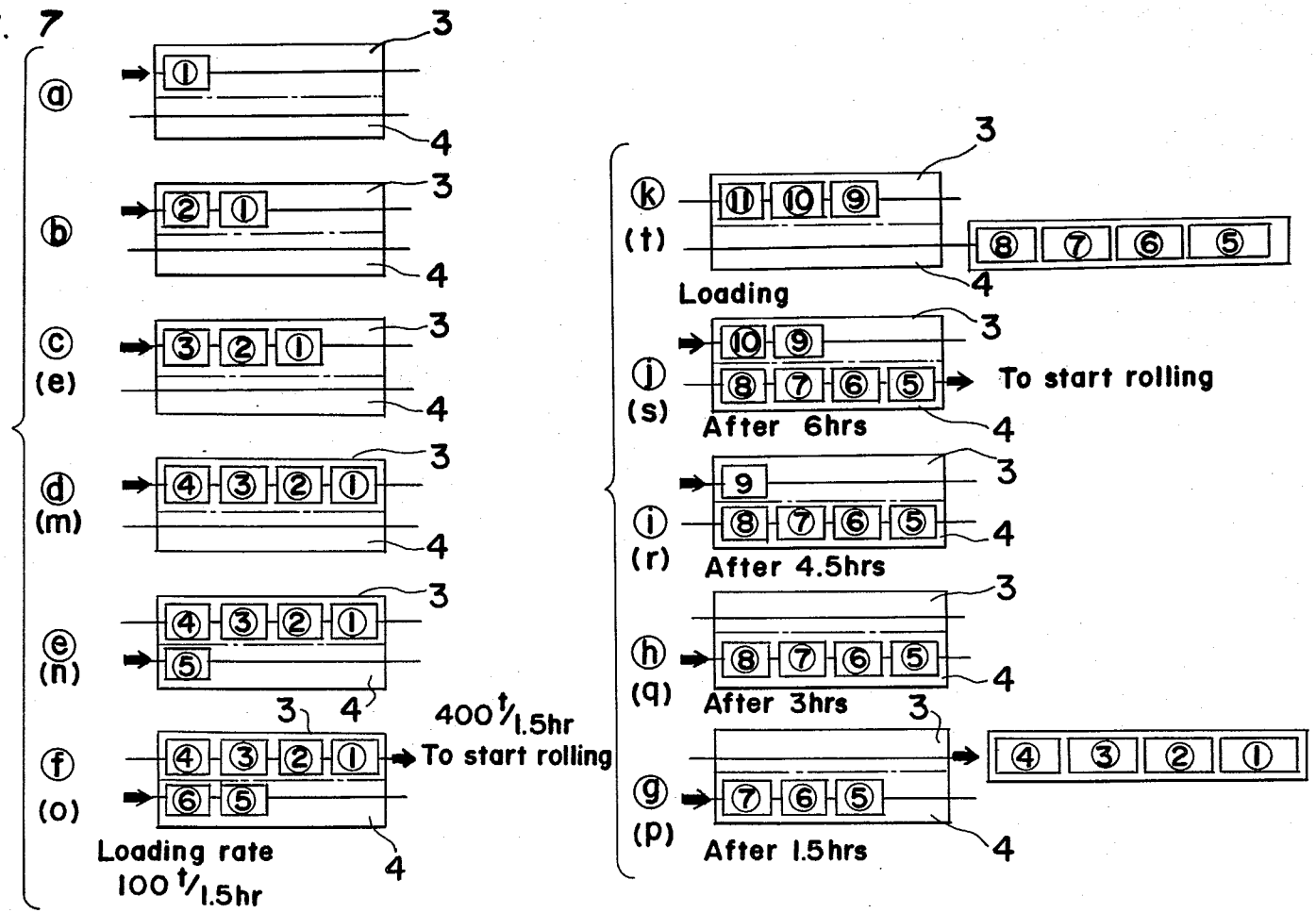
Figure 8:
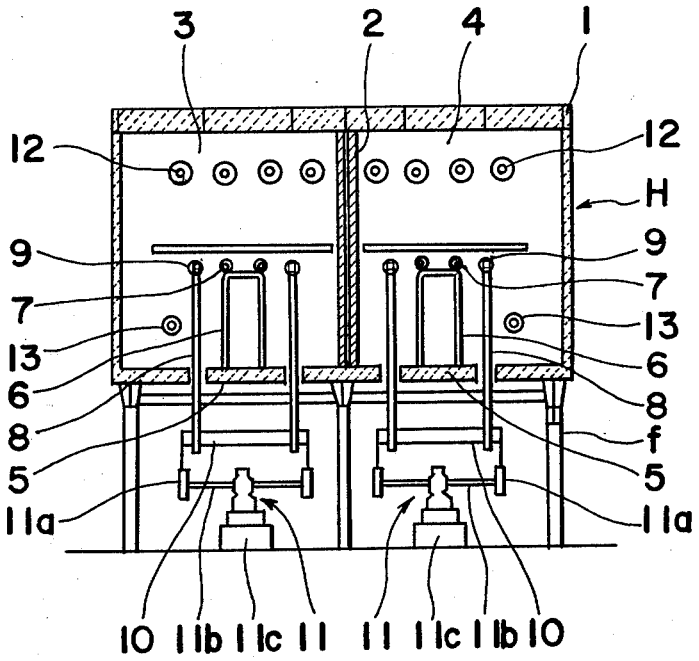

FIGS. 6(*a*) to 6(*d*) are diagrams systematically showing operations in each of the processes in the continuous hot rolling line;

FIG. 7 is a diagram sequentially showing the state in the reheating furnace employed in the continuous hot rolling line; and FIG. 8 is a view similar to FIG. 5, but showing a modification of the partition wall in the furnace.

Before the description of the present invention proceeds, it is to be noted that like parts are designated by like reference numerals throughout several views of the attached drawings.

Figure 1:
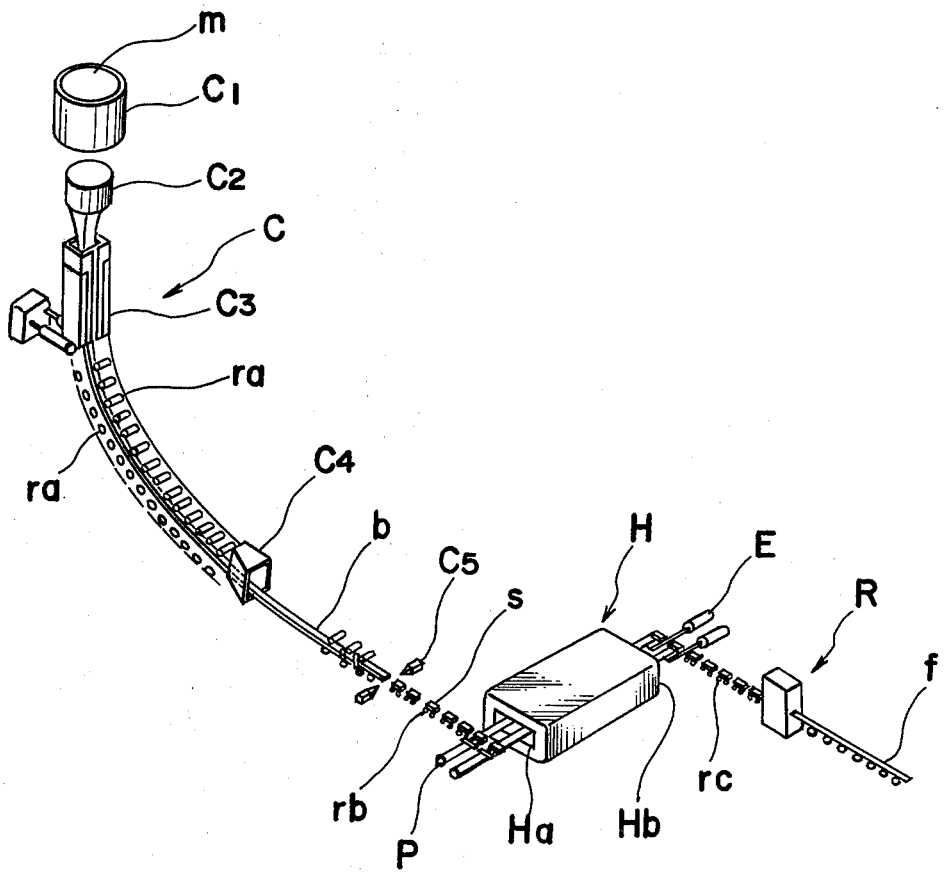
Figure 2:
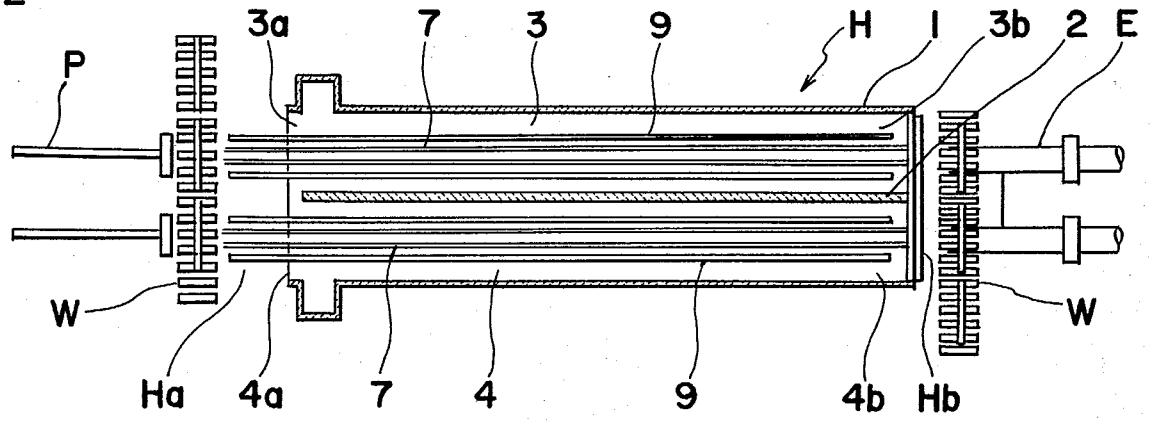
FIG. 2 is a schematic top plan view of a reheating furnace used in the hot rolling line according to one preferred embodiment of the present invention.
Figure 3:
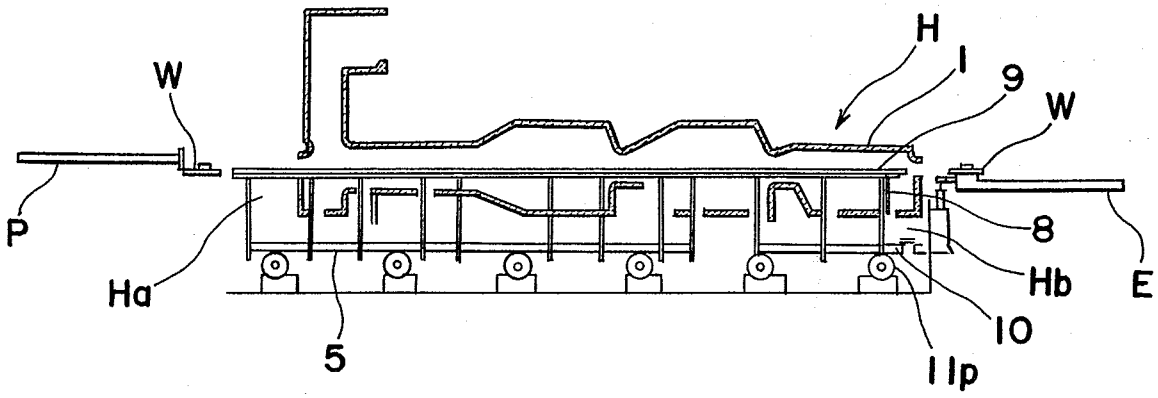
FIG. 3 is a side sectional view of the reheating furnace of FIG. 2.

Referring now to the drawings, there is shown in FIG. 1 an arrangement of a hot rolling line ranging from the continuous casting apparatus C to the rolling apparatus R between which a reheating furnace H directly related to the present invention and described later in more detail with reference to FIGS. 2 to 7 is arranged as a heating and buffer zone. In the continuous casting apparatus C, molten metal m contained in a laddle $C_1$ is fed into a tundish $C_2$ to be subsequently molded in a mold assembly $C_3$ into a continuous cast material, for example, in the form of a bar b, which is led between a number of pairs of guide rolls $r_a$ along a curved path through a straightener $C_4$, and the like sequentially arranged, and is subsequently cut into workpieces i.e., billets s and the like by cutting means $C_6$ in a known manner. The billets s thus formed are further transported by transportation rolls $r_b$ to a charge table (not shown) arranged adjacent to the charge side Ha of the reheating furnace H and are charged into the furnace H by pushers P. The billets s processed in the furnace H in a manner described later are then discharged from the furnace H onto a discharge table (not shown) arranged on the discharge side Hb of the furnace H by the action of the extractors E, and are further fed into the rolling apparatus R by transportation rolls $r_c$ so as to be rolled, for example, into the form of steel plates f.

Figure 4:
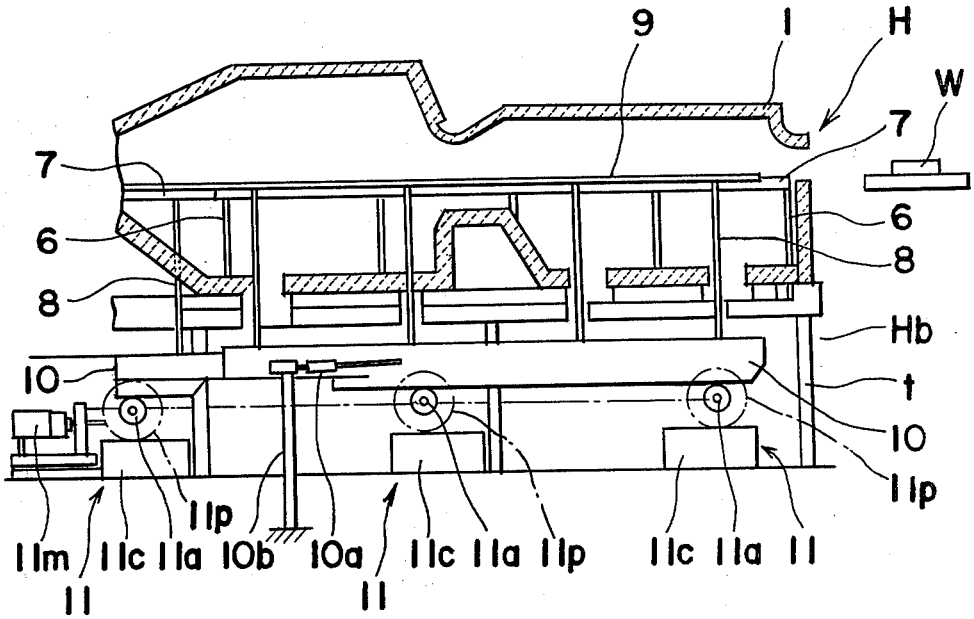
FIG. 4 is a view similar to FIG. 3, but particularly shows, on an enlarged scale, the detailed construction of a walking beam mechanism employed therein.

Referring also to FIGS. 2 to 5, the reheating furnace H according to the present invention, for example, of the walking beam type, includes a housing or furnace body 1 of refractory material supported above the ground by support members t; which reheating furnace H has a partition wall 2 built, for example, of refractory brick at approximately the central portion thereof and longitudinally extending from the charge end Ha to the discharge end Hb of the furnace H for dividing the interior of the furnace H into two heating sections 3 and 4 provided with separate inlets 3*a* and 4*a* and outlets 3*b* and 4*b* for the workpieces W (i.e., the billets s) respectively. In each of the heating sections 3 and 4, a plurality of stationary supporting columns 6 of the portal type having an upper beam and a pair of legs at both sides extend upwardly from an approximately central portion of a furnace floor 5 and are arranged in spaced relation from each other in the longitudinal direction of the furnace H, while stationary rails 7 are secured to upper beam ends of the supporting columns 6 to extend side by side in the longitudinal direction of the furnaces H. Along opposite sides of the stationary rails 7 are two movable rails 9 extending in parallel relation to the stationary rails 7 and supported, with said rails 7 arranged therebetween, on the upper ends of movable support columns 8 which extend through openings formed in the floor 5 and which are secured, at the lower ends thereof, to carriages 10 as is most clearly seen in FIG. 4. The movable rails 9 are each driven vertically by the carriages 10 which in turn are driven by independent driving means 11 including, for example, eccentric wheels 11*a* contacting the under surfaces of the carriages 10 and rotatably supported together with pulleys 11*p* on crank shafts 11*b* supported on support members 11*c* and driven by motor means 11*m* through a belt member (not shown) extending around the pulleys 11*p* and the driving shaft of the motor means 11*m*. The movable rails 9 are also each driven in horizontal movement, for example, by a pair of hydraulic rams 10*a* provided on opposite sides of the carriages 10 and each pivotally connected at its one end to the side of the carriges 10 and at its other end to a support member 10*b* secured to the ground (FIG. 4). By the above arrangement, workpieces W charged into the reheating furnace H are transported through the furnace H, while being alternately supported on the movable rails 9 and stationary rails 7 as the movable rails 9 are driven vertically and horizontally in the manner as described earlier. Furthermore, for making it possible to sufficiently heat the upper and lower surfaces of each of the workpieces W, burners, for example, axial-flow burners 12 and 13 are provided in the upper and lower portions of the furnace with respect to a path of advance of the workpieces W, and the heating sections 3 and 4 are adapted to be controlled individually with respect to temperatures in the longitudinal direction of the reheating furnace H by control means (not shown). It is to be noted that the partition wall 2 provided in the furnace H may have a hollow structure for further improving the heat insulating property, as shown in FIG. 8.

For operating the reheating furnace H of the above described construction, the workpieces W delivered from the continuous casting process C are successively charged into one section for example, into the section 3 of the heating sections 3 and 4 until the section 3 is filled up, and subsequently into the other section 4, with the movement of the moving beams 9 into the heating section 3 being thereafter suspended, while temperature control is effected for each heating section in the longitudinal directon of the furnace so that, until the workpiece W last charged into the furnace H has been heated up to the predetermined rolling temperature, the other workpieces W are held at the predetermined rolling temperature.

Referring also to FIGS. 6(*a*) to 7, the method of operation of the heating furnace H is described in detail hereinbelow with reference to examples of actual operations.

In FIGS. 6(*a*), molten metal, for example, molten steel is introduced into the continuous casting apparatus C from a converter (not shown) at the rate of 200 tons per 3 hours, and the cast workpieces W are continuously charged into the reheating furnace H as heated steel pieces or warm steel pieces at the rate of 100 tons per 1.5 hours (FIG. 6*c*) and are sequentially heated up to the predetermined rolling temperature in the furnace H, with the workpieces W which have been heated being held in the heated state (FIG. 6(*c*)) until a number of workpieces W in an amount of 400 tons total have been heated up to the predetermined rolling temperature. On the assumption that the heating sections 3 and 4 of the reheating furnace H are successively loaded with the workpiece W in the order of steps ⓐ, ⓑ, ⓒ, ⓓ, and ⓔ in FIG. 7 and reach the state in f at the time period (f) in FIG. 6(*d*) whereat the last charged workpiece ④ in the heating section 3 has been sufficiently heated, with workpieces W in an amount of 400 tons total being held at the predetermined rolling temperatures, the workpieces ① to ④ are collectively forwarded in one group from the heating section 3 toward the rolling apparatus R as shown at ⓖ in FIG. 7 for starting rolling which is completed after 1.5 hours, while a fresh workpiece ⑦ is charged into the heating section 4 for being heated, with the workpiece ⑤ which has been heated is held at the predetermined rolling temperature (FIG. 7-ⓗ). When the workpiece 8 which is the last one to be charged into the heating section 4 has been heated up to the predetermined rolling temperature, the workpieces ⑤ to ⑧ are collectively fowarded from the heating section 4 toward the rolling apparatus R to start rolling (FIG. 6(*d*) and FIG. 7-ⓙ). By repeating the above procedures as in (l) to (t) in FIG. 7, the workpieces W continuously produced by the continuous casting apparatus C and alternately charged into the heating sections 3 and 4 of the reheating furnace H to be heated and held at the predetermined rolling temperature are subjected to rolling by the rolling mill R intermittently operated at the predetermined rolling time interval (4.5 hours).

As is clear from the foregoing description, according to the present invention, the reheating furnace H employed as the heating and buffer zone directly connecting the lower speed apparatus such as the continuous casting apparatus C and the like with the higher speed rolling apparatus R is longitudinally divided into two sections 3 and 4 and is operated to alternately change over the sections so as to receive the workpieces W for heating in such a manner that the workpieces W are charged into one of the two sections after the other of the same two sections has been filled up, and also to collectively foward the heated workpieces W to the rolling apparatus R. By this arrangement, an increase of furnace length is advantageously avoided and the cost of the installation is lower than that for the simultaneous installation of a plurality of reheating furnaces, and efficient heating is achieved in a reduced space, and the low speed continuous charge and high speed discharge of the workpieces can be effected simultaneously without altering the transportation rate of such workpieces. Furthermore, since the two heating section 3 and 4 in the reheating furnace H divided by the partition wall 2 can be controlled with respect to temperatures depending on the conditions in the interior of the reheating furnace, high thermal efficiency is available at low operating cost.

It should be noted here that, although the present invention is mainly described with reference to the top and bottom firing type walking beam furnace in the foregoing embodiment, the invention is not limited in its application only to such a walking beam furnace, but may readily be applicable to a top firing type walking hearth furnace having a brick hearth.

It should also be noted that the present invention is not limited in its application to a continuous hot rolling line ranging from the continuous casting apparatus to the rolling apparatus, but can effectively be employed as a buffer furnace for a continuous processing line from a blooming mill to a rolling apparatus, for example, a slabing mill, in the hot direct rolling proces (HDR) which has recently been proposed.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as being included therein.

What is claimed is:

1. A reheating furnace between a continuous casting means for casting workpieces at one rate and a rolling line for carrying out rolling of the workpieces at a different rate higher than the rate of casting workpieces, said reheating furnace comprising:

a housing extending in the direction of transportation of the workpieces from the continuous casting means to the rolling line, said housing having a partition wall extending in the direction of transportation dividing said housing into first and second independent heating sections extending longitudinally of said housing, each section having an inlet at the end adjacent said continuous casting means for receiving workpieces from said continuous casting means and an outlet at the end adjacent said rolling line for discharge of said workpieces into said rolling line, a walking beam means in each section of said housing for transporting workpieces along the corresponding section;

a driving means for each walking beam means for driving the respective walking beam means independently of each other at a first speed corresponding to the one rate and a second speed corresponding to the different rate; and burner means in each section individually operable for heating the sections separately, whereby one of said sections can be charged with workpieces which are being produced at said one rate and can start heating the workpieces, while the other of said sections is heating the workpieces to the desired rolling temperature and maintaining them at that temperature and feeding them to the rolling line at said different rate.

2. A reheating furnace as claimed in claim 1 in which said partition wall is a hollow wall.

* * * * *